US005328589A

United States Patent [19]

Martin

[11] Patent Number: 5,328,589

[45] Date of Patent: Jul. 12, 1994

[54] FUNCTIONAL FLUID ADDITIVES FOR ACID COPPER ELECTROPLATING BATHS

[75] Inventor: Sylvia Martin, Shelby Township, Macomb County, Mich.

[73] Assignee: Enthone-OMI, Inc., Warren, Mich.

[21] Appl. No.: 996,095

[22] Filed: Dec. 23, 1992

[51] Int. Cl.[5] ..... C25D 3/38

[52] U.S. Cl. ..... 205/296; 106/126

[58] Field of Search ..... 205/296; 106/1.26

[56] References Cited

U.S. PATENT DOCUMENTS 3,267,010 8/1966 Creutz ..... 204/52
3,328,273 6/1967 Creutz ..... 204/52
3,770,598 11/1973 Creutz ..... 204/52 R
3,832,291 8/1974 Arcilesi ..... 205/296
4,110,176 8/1978 Creutz ..... 204/52 R
4,336,114 6/1982 Mayer et al. ..... 204/52 R
4,374,709 2/1983 Combs ..... 204/30

*Primary Examiner*—John Niebling
*Assistant Examiner*—Edna Wong
*Attorney, Agent, or Firm*—Harness, Dickey and Pierce

[57] ABSTRACT

A process and composition for high acid/low metal copper electroplating baths with improved leveling, adhesion, ductility and throwing power. The bath includes effective amounts of a functional fluid having at least one ether group derived from an alcohol epoxy or a bisphenol A and containing ethoxy and propoxy functionalities.

21 Claims, No Drawings

FUNCTIONAL FLUID ADDITIVES FOR ACID COPPER ELECTROPLATING BATHS

TECHNICAL FIELD

The present application relates to high acid/low metal copper electroplating baths. More particularly, the present invention relates to functional fluid additives for such solutions.

BACKGROUND OF THE INVENTION

In recent years, many advances in the area of electroplating of copper deposits have produced increasingly superior properties in ductility, leveling and other properties of copper deposits produced from high metal low acid electroplating baths. Primarily, these advances have been in the use of various additions to such copper electroplating baths. Most notably, the additions of divalent sulfur compounds and alkylation derivatives of polyethylene imines have resulted in improved leveling in decorative copper plating. Examples of these types of additions are shown in U.S. Pat. No. 4,336,114 to Mayer et al.; U.S. Pat. No. 3,267,010 to Creutz et al.; U.S. Pat. No. 3,328,273to Creutz; U.S. Pat. No. 3,770,598 to Creutz et al.; and U.S. Pat. No. 4,109,176 to Creutz et al. While these additions have found commercial acceptance in plating of high metal low acid copper baths, they have not solved problems inherent in electroplating of parts from high acid/low metal copper baths, U.S. Pat. No. 4,374,709 to Combs is a process for plating of copper on substantially non-conductive substrates utilizing high acid/low metal copper baths. While this process has been a great advance in the art of plating of non-conductive substrates, there remains a need for improved and simplified plating of metallic and non-conductive substrates and also in troublesome plating functions such as: plating of intricate parts with low current density areas; circuit board plating and other plating of substrates with surface imperfections; and in barrel plating applications.

For instance, barrel plating has been fraught with problems with regard to copper plating of parts. Typically, barrel plating operations have suffered from lack of proper adhesion between the built up layers of copper plate on the parts. Thus, barrel plating of parts has not been suitable from a production or sales standpoint. Copper plating applied on intricately shaped parts has been fraught with adhesion problems during thermal expansion cycles; thickness deficiencies in low current density areas; and suffer because of the low ductility of the deposit produced. Additionally, with respect to non-conductive plating of perforated circuit board material, or other substrates with substantial surface imperfections, the leveling properties of past plating methods have not been sufficient to overcome such surface imperfections in these substrates.

Thus, it has been a goal in the art to produce an electroplating bath and process which provides improved ductility copper deposits; has superior leveling and adhesion characteristics; and which has improved throwing power, beneficial in areas of low current density.

SUMMARY OF THE INVENTION

In accordance with the above goals and objectives, in the present invention there is provided an improved high acid/low copper bath and process for plating of copper. The process comprises the use of effective amounts of a functional fluid having triple ether functionality, in the electroplating bath, for improved copper deposits.

Compositions in accordance with the present invention provide improved copper plating in low current density areas and have superior gap and surface imperfection filling capabilities, for plating across gaps or other imperfections in substrates, while providing good adhesion and ductility properties. Additionally, utilizing the compositions of the present invention there is provided an improved acid copper bath whereby barrel plating of parts can be accomplished with acid copper baths.

DESCRIPTION OF THE PREFERRED EMBODIMENTS

In accordance with the composition and method aspects of the present invention, the invention is operable in aqueous acidic copper plating baths wherein high concentrations of acid are used with low copper ion concentrations for electroplating.

Aqueous acidic copper plating baths of the present invention are typically of the acidic copper sulfate type or acidic copper fluoborate type. In accordance with conventional practice, aqueous acidic copper sulfate baths typically contain from about 13 to about 45 g/l of copper ions with preferred concentrations of from about 25 to about 35 g/l. Acid concentrations in these baths typically range from about 45 to about 262 g/l of acid and preferably amounts of from about 150 to about 220 g/l acid. Fluoborate solutions would use the same ratio of acid to metal in the bath. The additives of the present invention are particularly advantageous in such low copper ion/high acid solutions.

In accordance with the method aspects of the present invention, the acidic copper plating baths of the present invention are typically operated at current densities ranging from about 5 to about 60 amperes per square foot (ASF) although current densities as low as about 0.5 ASF to as high as about 100 ASF can be employed under appropriate conditions. Preferably, current densities of from about 5 to about 50 ASF are employed. In plating conditions in which high agitation is present, higher current densities ranging up to about 100 ASF can be employed as necessary and for this purpose a combination of air agitation, cathode movement and/or solution pumping may be employed. The operating temperature of the plating baths may range from about 15° C. to as high as about 50° C. with temperatures of about 21° C. to about 36° C. being typical.

The aqueous acidic sulfate bath also desirably contains chloride ions which are typically present in amounts of less than about 0.1 g/l. The method and compositions of the present invention are compatible with commonly utilized brightening agents such as polyethylene imine derivative quaternaries such as disclosed in U.S. Pat. No. 4,110,776 and disulfide additives such as those disclosed in U.S. Pat. No. 3,267,010, which patents are hereby incorporated herein by reference. Additionally, the alkylation derivatives of polyethylene imines such as that disclosed in U.S. Pat. No. 3,770,598, which hereby is incorporated herein by reference, may also be utilized as set forth in that patent. Other additions may include propyl disulfide phosphonates and R-mercapto alkyl sulfonate type derivatives with $S^{-2}$ functionality. In addition, when the present invention is utilized in a composition for plating of electronic circuit boards or the like the additives set forth in U.S. Pat. No. 4,336,114, which is hereby incorporated herein by reference, may be utilized as set forth therein and known in the art. High acid/low metal plating baths and suitable additives are set forth in U.S. Pat. No. 4,374,409, also incorporated herein by reference thereto.

In accordance with the composition and process of the present invention effective amounts of a functional fluid having triple ether functionality are utilized for providing superior ductility, leveling over substrates and including gap filling properties heretofore unrealized in such plating solutions. Functional fluids useful in the present invention include a polymer having an alkyl ether end group with propoxy and ethoxy functionality in the main chain. The functional fluids suitable for use in the present invention are bath soluble. Typically, functional fluids useful in the present invention are characterized by the following formula.

$$(R_1)_m(R_2)_n(R_3)_oR_4$$

wherein:

$R_2$ and $R_3$ are interchangeable in their order within the above formula and preferably are blocks of either $R_2$ or $R_3$, however, random mixtures of $R_2$ or $R_3$ is also possible;

$R_1$ is selected from the group consisting of: an ether group derived from an alcohol moiety having from about 4 to about 10 carbon atoms; an ether group derived from a bisphenol A moiety; an epoxy derived ether moiety with 4–6 carbon atoms or mixtures thereof, and m is selected to be from about 1 to about 10 but preferably from 1 to 3.

$R_2$ is selected from the group consisting of:

$$-\underset{}{\overset{CH_3}{\overset{|}{CH}}}-CH_2-O-;$$

$$-CH_2-\overset{CH_3}{\overset{|}{CH}}-O-;$$

$$-CH_2-CH_2-CH_2-O-;$$

$$-\overset{CH_3}{\underset{CH_3}{\overset{|}{\underset{|}{C}}}}-O-$$

and mixtures thereof; and $R_3$ is selected from the group consisting of $$-\overset{CH_3}{\overset{|}{CH}}-O;\ -CH_2CH_2-O-$$

and mixtures thereof; and $R_4$ is selected from the group consisting of H, $CH_3$, an alkyl group, a hydroxyalkyl group, alkylether groups having 1 to 3 carbons, a polar alkyl group, an ionic constituent or an alkyl group having an ionic constituent such as carboxylic acid, sulfate, a sulfonate, a phosphonate or alkali metal ion and mixtures thereof wherein n and o are selected such that the ratio of n to o is from about ½:1 to about 1:30. Preferably the ratio of n to o is from about 1:1 to 1:20. The $R_4$ moiety may include a sodium or other alkali ion for forming a salt as well as ammonium ions.

The functional fluid of the present invention generally has a molecular weight of from about 500 to 10,000. Preferred molecular weights of the functional fluids are from about 1,000 to about 2,500 in the embodiments set forth below.

The preferred $R_1$ moiety is a butyl ether group derived from butyl alcohol. However, longer chain alkyl ether groups may be used as set forth above. Use of functional fluids wherein $R_1$ is derived from some of the longer chain alcohols, for instance having 9 or 10 carbons, may result in foaming conditions in the bath. However, if this occurs, the quantity of the fluid may be reduced to alleviate foaming conditions.

As examples, typical functional fluids useful in the present invention are commercially available from Union Carbide as UCON®HB and H series fluids. Particularly, preferred functional fluids include 50 HB and 75 H series fluids such as 50 HB 660; 50 HB 5100; 50 HB-260; 75 H 450; 75 H 1400; and 75 H 90,000.

The methods and compositions of the present invention find advantageous use in four related but distinct areas of copper plating. These four areas include acid copper strikes; acid copper circuit board plating; barrel plating; and high throw decorative plating applications.

When used in a bright copper strike bath, generally, from about 1 mg/l to about 1000 mg/l of the functional fluid is utilized in baths for bright copper strikes. Typically, such baths require use of from about 1 mg/l to about 700 mg/l with preferred ranges being from about 3 mg/l to about 120 mg/l of the functional fluid. Such a process when used in bright copper strikes allows increased leveling and adhesion in low current density areas such that intricate shaped parts may be more advantageously plated utilizing the process and methods of the present invention in high acid/low copper solutions. Typically, when utilized as a bright copper strike method greater amounts of disulfide preferably in the range of from about 1 to about 30 mg/l of a disulfide with preferred ranges being from about 5 to 15 mg/l. Brighteners such as the quaternary polyethylene imines are useful in quantities of from about 1 to about 5 mg/l and preferably 1 to 2 mg/l in such solutions.

With respect to electronics grade plating operations such as plating of perforated circuit board and the like, the present process produces fine grain to satin grain type plates and is an improvement in leveling out over surface imperfections and produces uniform copper coatings in the holes with excellent deposit physical properties.

Thus, for electronics plating applications such as functional fluids are utilized in quantities generally from about 20 to about 2000 mg/l. Typically 40 to about 1500 mg/l would be utilized. In a preferred embodiment of the present invention 120 to about 1000 mg/l functional fluid is utilized. Although not necessary, in a preferred embodiment from about 0.2 to about 0.20 mg/l of sulfide compounds are useful in baths of such electronic plating processes. Also, small amounts of brighteners such as quaternary polyethylene imines can be utilized in quantities of from about 1 to about 5 mg/l in the process of the present invention.

With respect to barrel plating applications of the present invention, in the past it has been commercially impractical to utilize barrel plating for copper strikes and the like in high acid/low copper solutions. However, in the advantageous use of the present invention it is now possible to utilize barrel plating for copper plating of smaller intricate parts and the like. In barrel plating systems the copper strike typically is preferred to be brighter and ductility is not as important as in some of the other applications. However, layered adhesion in barrel plating is critical. Prior to the present invention layer adhesion has been a serious problem which made such plating operations impractical. In the present invention this is corrected by utilizing the functional fluid as set forth above in quantities of from about 10 to about 1200 mg/l. Typically from about 40 to 700 mg/l and preferably 60 to 600 mg/l are utilized in barrel plating of parts in the present invention. When utilizing functional fluids in any of the baths set forth above, it is a general rule that greater quantities of lower molecular weight polymers are needed for proper performance, whereas, if higher molecular weight functional fluids are used smaller quantities may be utilized for achieving the desired results.

The functional fluid additions of the present invention are also advantageous in that they work well in decorative baths including common brighteners, dyes and the like used in such baths. Thus, the present invention can be used in low metal/high acid production systems already in place for achieving improved results.

Further understanding of the present invention will be had with reference to the following examples which are set forth herein for purposes of illustration but not limitation.

EXAMPLE I

Copper Strike

A copper strike bath utilizing 175 g/l of copper sulfate pentahydrate; 195 g/l·sulfuric acid; 60 mg/l chloride-ion; and 40 mg/l functional fluid (*MW 4000) is provided. Electroless nickel plated ABS panels are plated with air agitation at 15 ASF with a bath temperature of about 80° F. The copper strike deposits on these parts were fine grained and uniform.

*Butyl ether-polypropoxyether-polyethoxyether with hydroxy end groups.

EXAMPLE II

Decorative

To a bath as set forth above was added 20 mg/l sodium 3,3 sulfo propane 1,1 disulfide; 9 mg/l Janus Green Dye. The parts were plated with air agitation at 30 ASF with a 92° F. bath temperature. The copper deposit on the parts was uniformly lustrous with all base metal imperfections leveled out after 30 minutes of bath operation.

EXAMPLE III

Plating of Circuit Boards

A plating bath was prepared using 67.5 g/l copper sulfate pentahydrate; 172.5 g/l concentrated sulfuric acid; 60 mg/l chloride-ion; and 680 mg/l butoxy propyloxy ethyloxy polymer functional fluid (MW 1100). A copper clad laminate circuit board was plated at 24 ASF with air agitation at 75° F. The copper deposit was uniform, semi-bright, fine grained and very ductile. The deposit passes 10 thermal-shock cycles without separation, showing the superior physical properties of the copper deposit.

EXAMPLE IV

Acid Copper Strike

A bath was prepared utilizing 75 g/l copper sulfate pentahydrate; 187.5 g/l concentrated sulfuric acid; 65 mg/l chloride ion; 80 mg/l butyl-oxy-propyloxy-ethyloxy polymer functional fluid (MW 1100); 1 mg/l [3-sulfopropyl]$_2$disulfide sodium salt; 1.5 mg/l poly (alkanol quaternary ammonium salt as per U.S. Pat. No. 4,110,176). Electroless copper plated ABS panels were plated utilizing 15 ASF at a temperature of 85° F.

The strike produced had good ductility and adhesion qualities even in low current density areas and would readily accept subsequent nickel and chromium deposits readily.

EXAMPLE V

Barrel Plating Example

A barrel plating bath was formulated utilizing 75 g/l copper sulfate pentahydrate; 195 g/l concentrate sulfuric acid; 75 ppm (75 mg/l) chloride-ion; 100 mg/l functional fluid (MW 1700); 2 mg/l 3,3 sulfopropyl disulfide; 1 mg/l polyethylene quaternary. Plating of small steel parts having a cyanide free alkaline copper strike was accomplished at 7–10 ASF average cathode current density. The plating on the parts was bright, uniform, with good leveling and adhesion between layers. These parts will accept subsequent nickel and chromium deposits readily. The copper deposit was very ductile allowing for thick electroforming applications.

EXAMPLE VI

Baths are prepared utilizing as follows: (a) 20 g/l copper ions; 225 g/l sulfuric acid; (b) 14 g/l copper ions 45 g/l sulfuric acid; (c) 45 g/l copper; 100 g/l sulfuric acid; and (d) 15 g/l copper ions; 262 g/l sulfuric acid.

These baths are then utilized to form copper plating baths of the present application by adding from 1 to 2,000 mg/l of functional fluids having butoxy, ethoxy and propoxy functionality with molecular weights from 500 to 10,000. Electroplated parts produced are found to have copper plating producing fine grained deposits with good adhesion, ductility and throwing properties.

EXAMPLE VII

Printed Circuit Boards

A plating bath was prepared using 69 g/l copper sulfate pentahydrate; 225 g/l sulfuric acid, and 80 mg/l chloride. To this bath is added 700 mg/l of 2,2 dimethyl 2,2 diphenol propylene reacted with 12 moles propylene oxide followed by 20 moles of ethyleneoxide, sulfated to 30–50% of the final content of end hydroxy groups, as an ammonium salt. Copper clad laminate circuit boards are processed at 20 ASF for 1 hour, the deposit was fine grained, ductile, uniform, and exhibited excellent low current density thickness.

While the above description constitutes the preferred embodiments it is to be appreciated that the invention is susceptible to modification, variation and change without departing from the proper scope and fair meaning of the accompanying claims.

What is Claimed is:

1. An improved high acid/low copper electroplating bath for plating of copper onto substrates comprising:

from about 13 to about 45 g/l copper ions; from about 45 to about 262 g/l of an acid with effective amounts of a bath soluble multi-functional polymer said polymer comprising at least three distinct ether groups linked in said polymer wherein one of the ether linkages is derived from an alcohol, a bisphenol A or an epoxy and also comprising propoxy and ethoxy groups said multi-functional polymers providing improved leveling over surface imperfections, improved adhesion and improved plating in low density current areas.

2. The improved copper electroplating bath of claim 1 wherein the effective amount of the functional polymer further comprises:

from about 1 to about 2000 mg/l of a functional fluid having the formula:

$$(R_1)_m—(R_2)_n—(R_3)_o—R_4$$

wherein:

$R_1$ is selected from the group consisting of: an alkyl ether group derived from an alcohol having from about 4 to about 10 carbon atoms; an ether group derived from a bisphenol A moiety; an ether group derived from an epoxy moiety; or mixtures thereof; and, m is selected to be from about 1 to about 10;

$R_2$ and $R_3$ are interchangeable in their order within the formula and are utilized in blocks or random order in the formula;

$R_2$ is selected from the group consisting of:

$$-\underset{}{\overset{CH_3}{\overset{|}{CH}}}-CH_2-O-;$$

$$-CH_2-\overset{CH_3}{\overset{|}{CH}}-O-;$$

$$-CH_2-CH_2-CH_2-O-;$$

$$-\overset{CH_3}{\underset{CH_3}{C}}-O-$$

and mixtures thereof; and $R_3$ is selected from the group consisting of $$-\overset{CH_3}{\overset{|}{CH}}-O;\ -CH_2CH_2-O-$$

and mixtures thereof: and $R_4$ is selected from the group consisting of H, $CH_3$, an alkyl group, a hydroxyalkyl group, alkylether groups having 1 to 3 carbons, a polar alkyl group, an ionic constituent or an alkyl group having an ionic constituent and mixtures thereof wherein n and o are selected such that the ratio of n to o is from about ½:1 to about 1:30 and such that the functional fluid has a molecular weight of from about 500 to 10,000.

3. The bath of claim 2 wherein said molecular weight of said functional fluid is from about 1,000 to about 2,500.

4. The bath of claim 2 wherein said functional fluid is used in amounts of from about 1 to about 1,000 mg/l.

5. The bath of claim 2 wherein said ratio of n to o is from about 1:1 to about 1:20.

6. The bath of claim 2 wherein $R_1$ is an alkyl ether derived from an alcohol or epoxy having from about 4 to about 6 carbon atoms.

7. The bath of claim 2 wherein said functional fluid is used in amounts of from about 10 to about 1,200 mg/l.

8. The bath of claim 2 wherein m is from about 1 to about 3.

9. A process for electrolytic depositing of a copper deposit onto a substrate comprising the steps of:

1) providing an improved high acid/low copper plating bath having from about 15 to about 45 g/l copper ions, from about 45 to about 262 g/l of an acid and a bath soluble multi-functional polymer having at least one 4 to 10 carbon chain ether group derived from an alcohol and having a bisphenol A or an epoxy, propoxy and ethoxy functionality contained in said solution in effective amounts for leveling of imperfections and good adhesion and ductility;
2) providing a substrate for electrolytic plating thereover and immersing said substrate in the bath; and
3) subjecting said bath to a sufficient electroplating current for depositing the copper deposit on the substrate, wherein the copper deposit provides enough thickness and conductivity to allow any desired further processing of the work.

10. The process of claim 9 wherein said functional polymer is a functional fluid having the formula:

$$(R_1)_m—(R_2)_n—(R_3)_o—R_4$$

wherein:

$R_1$ is selected from the group consisting of: an ether group derived from an alcohol moiety having from about 4 to about 10 carbon atoms; an ether group derived from a bisphenol A moiety; an ether group derived from an epoxy; and mixtures thereof and m is selected to be from about 1 to about 10;

$R_2$ and $R_3$ are interchangeable in their order within the formula;

$R_2$ is selected from the group consisting of:

$$-\overset{CH_3}{\overset{|}{CH}}-CH_2-O-;$$

$$-CH_2-\overset{CH_3}{\overset{|}{CH_2}}-O-;$$

$$-CH_2-CH_2-CH_2-O-;$$

$$-\overset{CH_3}{\underset{CH_3}{C}}-O-,$$

and mixtures thereof; and $R_3$ is selected from the group consisting of $$-\overset{CH_3}{\overset{|}{CH}}-O-;\ CH_2-CH_2-O-$$

and mixtures thereof; and $R_4$ selected from the group consisting of H, $CH_3$, an alkyl group, a hydroxyalkyl group, alkylether groups having 1 to 3 carbons, a polar alkyl group, an ionic constituent or an alkyl group having an ionic constituent and mixtures thereof wherein n and o are selected such that the ratio of n to o is from about ½:1 to about 1:30 and such that the functional fluid has a molecular weight of from about 500 to 10.000.

11. The process of claim 10 wherein said functional fluid has a molecular weight of from about 1000 to about 2,500.

12. The process of claim 10 wherein the bath further comprises a barrel plating bath and in said bath comprising from about 10 to about 1,200 mg/l of said functional fluid.

13. The process of claim 10 wherein the bath further comprises a bath for depositing copper for use in electrical applications and comprises from about 20 to about 2,000 mg/l of the functional fluid.

14. The process of claim 10 wherein the bath further comprises a copper strike bath and comprises from about 1 to about 1000 mg/l of the functional fluid.

15. The process of claim 10 wherein the ratio of n to o is from about 1:1 to about 1:20.

16. The process of claim 10 wherein $R_1$ is an alkyl ether group derived from an alcohol or epoxy having from about 4 to about 6 carbon atoms.

17. The process of claim 10 wherein m is from about 1 to about 3.

18. An improved copper electroplating bath for plating of copper onto substrates comprising:

from about 13 to about 45 g/l copper ions;

from about 45 to about 262 g/l of an acid;

effective amounts of brighteners and leveling additives; and from about 1 to about 2000 mg/l of a functional fluid having the formula:

$$(R_1)_m—(R_2)_n—(R_3)_o—R_4$$

wherein:

$R_1$ is selected from the group consisting of: an alkyl ether group derived from an alcohol having from about 4 to about 10 carbon atoms; an alkyl ether group derived from a bisphenol A moiety; an epoxy moiety; or mixtures thereof and m is selected to be from about 1 to about 3;

$R_2$ and $R_3$ are interchangeable in their order within the formula;

$R_2$ is selected from the group consisting of:

$$-\underset{}{\overset{CH_3}{\overset{|}{CH}}}-CH_2-O-;$$

$$-CH_2-\overset{CH_3}{\overset{|}{CH}}-O-;$$

$$-CH_2-CH_2-CH_2-O-;$$

$$-\overset{CH_3}{\underset{CH_3}{\overset{|}{\underset{|}{C}}}}-O$$

and mixtures thereof; and $R_3$ is selected from the group consisting of $$-\overset{CH_3}{\overset{|}{CH}}-O-;\ -CH_2CH_2-O-$$

and mixtures thereof; and $R_4$ is selected from the group consisting of H, $CH_3$, an alkyl group, a hydroxyalkyl group, alkylether groups having 1 to 2 carbons, a polar alkyl group, an ionic constituent or an alkyl group having an ionic constituent and mixtures thereof wherein n and o are selected such that the ratio of n to o is from about ½:1 to about 1:30 and such that the functional fluid has a molecular weight of from about 500 to 10.000.

19. The improved copper electroplating bath of claim 2 wherein said ionic constituent is selected from the group consisting of carboxylic acids, sulfates, sulfonates, phosphorates, alkali metal ions and mixtures thereof.

20. The process of claim 10 wherein said ionic constituent is selected from the group consisting of carboxylic acids, sulfates, sulfonates, phosphorates, alkali metal ions and mixtures thereof.

21. The process of claim 18 wherein said ionic constituent is selected from the group consisting of carboxylic acids, sulfates, sulfonates, phosphorates, alkali metal ions and mixtures thereof.

* * * * *